US005503268A

United States Patent [19]

Pham

[11] Patent Number: 5,503,268

[45] Date of Patent: Apr. 2, 1996

[54] CONTAINER FOR CYLINDRICAL ARTICLES AND METHOD FOR LOADING AND DISPENSING

[75] Inventor: Xuan M. Pham, Richmond, Va.

[73] Assignee: Philip Morris Incorporated, New York, N.Y.

[21] Appl. No.: 91,032

[22] Filed: Jul. 14, 1993

[51] Int. Cl.[6] ..... A24F 15/00

[52] U.S. Cl. ..... 206/249; 206/250

[58] Field of Search ..... 206/242, 249, 206/250; 229/9, 10, 11, 19; 221/303, 305, 312 R, 312 C

[56] References Cited

U.S. PATENT DOCUMENTS

| | | | |
|---|---|---|---|
| 542,903 | 7/1895 | Truax | 229/9 |
| 727,600 | 6/1903 | Doscher . | |
| 1,101,907 | 6/1914 | Cummings . | |
| 1,912,967 | 10/1931 | Brunner . | |
| 2,130,602 | 9/1938 | Smith | 229/9 |
| 2,497,455 | 5/1947 | Johnson . | |
| 2,929,542 | 3/1960 | O'Gorman . | |
| 2,936,944 | 5/1960 | Moore . | |
| 3,071,306 | 1/1963 | Trethewey . | |
| 3,083,820 | 4/1963 | Roberts . | |
| 3,439,797 | 4/1969 | Todman et al. | 206/249 |
| 3,877,573 | 4/1975 | Scott et al. . | |
| 3,987,955 | 10/1976 | Sarrinen . | |
| 4,658,984 | 4/1987 | Brunner | 221/305 |

FOREIGN PATENT DOCUMENTS

| | | |
|---|---|---|
| 285778 | 2/1928 | United Kingdom . |
| 387374 | 2/1933 | United Kingdom . |

*Primary Examiner*—Thomas P. Hilliard
*Attorney, Agent, or Firm*—Burns, Doane, Swecker & Mathis

[57] ABSTRACT

The disclosure relates to containers and blanks for forming the containers. The disclosed methods involve forming the containers, loading the containers with cylindrical articles such as cigarettes and dispensing the articles from the containers. The containers may include a box and a telescoping closure sleeve for selectably exposing a circular aperture in a side wall of the box. An inner wall of the box provides a curved surface for aligning an individual article or cigarette so that it may be dispensed through the aperture. The methods and structures disclosed here permit the container to be accessed and the articles or cigarettes to be dispensed, one at a time, by manipulating the container with one hand. A window in the sleeve permits the contents of the container to be viewed through an opening in the box.

13 Claims, 5 Drawing Sheets

CONTAINER FOR CYLINDRICAL ARTICLES AND METHOD FOR LOADING AND DISPENSING

BACKGROUND AND OBJECTS OF THE DISCLOSURE

The present invention relates to a container and a method of loading and dispensing articles from such a container. The container and method are particularly adapted for use in dispensing cylindrical smoking articles such as cigarettes.

Conventional cigarette packages, including flip-top packs, provide access to several or all of the cigarettes in the package through the top of the package. Individual cigarettes must be selected, manually separated and withdrawn from the package with the fingers. Typically, selecting a single cigarette for withdrawal is a two-handed operation. The pack may be impacted to cause one or a few cigarettes to extend from the top of the pack for grasping. However, this procedure can cause ejection and loss of cigarettes if not done properly.

An alternative approach in the design of a cigarette package, known in the prior art, is illustrated in U.K. Patent No. 387,374. While this package is adapted to pass only one cigarette at a time from a row of cigarettes within the package, the structure has several disadvantages relating to the ease of fabricating of the package and ease of loading and dispensing the cigarettes, as will be discussed in greater detail below.

Modern cigarette packages are fabricated and loaded on very high speed production lines. Accordingly, appropriate package configurations must be adapted to high speed die-cutting, folding, and gluing, and loading procedures.

Several fabrication disadvantages of the prior art are illustrated in the package of U.K. No. 387,374. The package includes a sliding drawer made of two separate cardboard blanks. Typically, an increase in the number of component parts increases the difficulty of fabrication of the package. The package of the '374 patent also includes a square aperture in an end wall, two edges of which are formed by walls perpendicular to the end wall. Aside from aesthetic considerations, this structure has the disadvantage of requiring the use of relatively thick wall materials to achieve rigidity and dimensional stability.

Accordingly, it is a general object of the present invention to provide a package or container which can be rapidly and economically cut, folded, assembled and loaded on a high volume production line to produce a rigid, dimensionally stable finished product.

Package closures present special problems. Tuck-in closure flaps (such as shown in U.K. Patent No. 387,374) suffer from the disadvantage that they are difficult to tuck and typically require two-hands to manipulate. Conventional packages with flip-top lids present other problems, including the difficulties of achieving complete closure and in locking of the lid in a closed position.

Containers for one-handed dispensing of small articles such as mints or troches are known in the art. See, for example, U.S. Pat. No. 3,877,573. In such containers a lid is opened or an aperture is exposed, and the container is shaken to eject the mints or troches. However, such containers are adapted for dispensing generally round articles and may eject a variable number of articles when given a single shake.

Accordingly, it is an object of the present invention to the present invention to provide a package or container which dispenses cylindrical smoking articles, such as cigarettes, one at a time.

It is another object of the present invention to provide a package or container for cylindrical smoking articles which can be operated with one hand. More particularly, it is an object of the present invention to provide a cigarette package from which cigarettes may be conveniently dispensed, one at a time, by tilting and shaking the package.

It is another object of the present invention to provide a package or container for dispensing cylindrical smoking articles with a closure mechanism which is self-locking.

It is another object of the present invention to provide a package or container for cylindrical smoking articles through which the articles are visible, while still protecting the articles from the environment.

These and other objects and features will be apparent from a reading of the following description of preferred embodiments. One or more of such objects may be achieved by the structures and methods presented in the claims.

SUMMARY OF PREFERRED EMBODIMENTS

A container is provided for elongated cylindrical articles such as cigarettes. The container may include two components: (1) a box or tray and (2) a closure means or sleeve for controlling access to the box or tray. Advantageously, the box or tray may have a width approximately equal to the length of the cylindrical article. A circular aperture in a wall of the box may be formed of a sufficient size to permit the elongated articles to pass out of the box in the general direction of their elongation.

The closure means or sleeve is provided to selectively block the aperture to prevent articles from passing out of the box. The sleeve may be slidable so that the box may be telescoped from the sleeve to reveal the aperture and dispense the cylindrical articles.

An inner surface of the wall of the box may be configured to align the cylindrical articles, one at a time, so that an end of the article is positioned adjacent to the aperture for dispensing. In a preferred embodiment, the inner surface of the box wall is a ramp curved about an axis passing through the center of the circular aperture and generally parallel to the axes of elongation of the cylindrical articles packed within the box.

A face of the box may be formed with an opening. The sleeve may be formed with a corresponding window to permit visual inspection of the contents of the box while closed. Advantageously, the window is made of transparent sheet material for preserving freshness of the contents of the box.

In a preferred embodiment, the box is formed from a single blank of cardboard or paperboard and the sleeve is formed from a separate blank of cardboard or paperboard. The box so formed has pairs of face, side and end walls. Each wall may be formed from spaced, parallel layers of cardboard or paperboard to increase rigidity of the formed box. The circular aperture is formed in one of the side walls.

A sleeve may be provided having pairs of side walls and face walls which are slidable across the corresponding side walls and face walls of the box to selectively expose the circular aperture. The sleeve may be formed from a second blank.

The container may be of sufficient dimension to permit the longitudinal loading and stacking of two columns of cigarettes through an opening in the box. The container may further include a detent tab for restricting slidable movement of the sleeve with respect to the box. More particularly, the detent tab is arranged to permit selective exposure and closure of the aperture, but prevent the sleeve from sliding to a position which would expose the loading opening.

A portion of the blank used to form the box may provide an inner wall for the box, configured to align the lowermost cylindrical article or cigarette so that one end of it is exposed at the aperture. This inner wall may be formed from a flap which extends from a bottom wall of the box in an arcuate path toward one of the face walls of the box. The flap may be formed with tabs to engage the side walls of the box to retain the flap in its arcuate configuration.

The present disclosure also relates to methods for loading and dispensing cylindrical smoking articles from a container of the general construction described above. In particular, a box is provided having a length approximately equal to the length of the cylindrical articles it contains. A side wall is formed with an aperture approximately equal in size and shape to the cross-sectional area of the cylindrical article. The box may be loaded with a plurality of cylindrical articles through an opening in a face wall of the box. In a preferred embodiment, the articles are gravity-loaded into the box by rolling the articles into position through the window. Once the box is loaded, a sleeve may be slid over the box to close the window of the box and the aperture. In a preferred embodiment, the loaded container may be wrapped with a transparent flexible material.

Dispensing of cylindrical articles, one at a time, may be accomplished by sliding the sleeve to expose the aperture, orienting the box to align an end of a lowermost smoking article adjacent to the aperture, and shaking or tapping the box to eject the lowermost smoking article through the aperture in a direction of the principle axis of the smoking article. These dispensing steps may be performed by manipulating the container with one hand. Once the dispensed cigarette is removed from the package, the sleeve may be slid to its closed position thereby blocking the aperture.

DETAILED DESCRIPTION OF THE DRAWINGS

Figure 1:
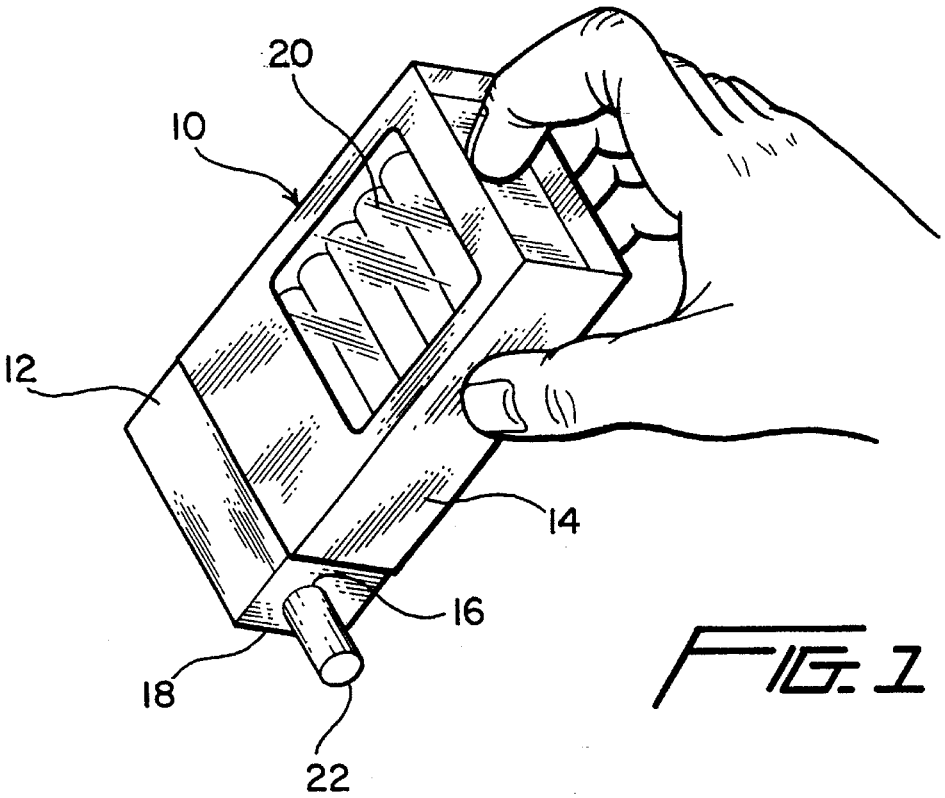
FIG. 1 is a pictorial view of a loaded cigarette package embodiment of the present invention shown dispensing a single cigarette.

Referring first to FIG. 1, a container 10 constructed in accordance with the teachings of the present disclosure is shown in a perspective view. The container is configured as a cigarette package and is shown being manipulated with the fingers of one hand to dispense a single cigarette.

The container 10 includes a body box or tray 12 and a cover sleeve 14. The sleeve 14 is slidable with respect to the box 12. As shown in FIG. 1, the sleeve may be held with the hand while an end of the box is pressed with an index finger of the same hand so that it telescopes from the sleeve.

A circular aperture 16 is formed in a side wall 18 of the box 12. Cylindrical smoking articles 20, such as cigarettes are packed in the box 12. The aperture is exposed when the sleeve 14 is positioned in the manner shown in the Figure. A single cigarette 22 is shown protruding through the aperture 16 in FIG. 1.

The container may be accessed and a cigarette dispensed from the container 10 by grasping the sleeve 14 between the fingers of one hand and pressing on an end of the box so that a bottom end of the box telescopes from the sleeve sufficiently to expose aperture 16. Advantageously, the box incorporates a stop or detent to prevent the box from sliding completely out of the sleeve. The package may be shaken or oriented so that gravity causes the single cigarette 22 to be dispensed from the container. The operation may be repeated until the container is emptied.

Figure 2:
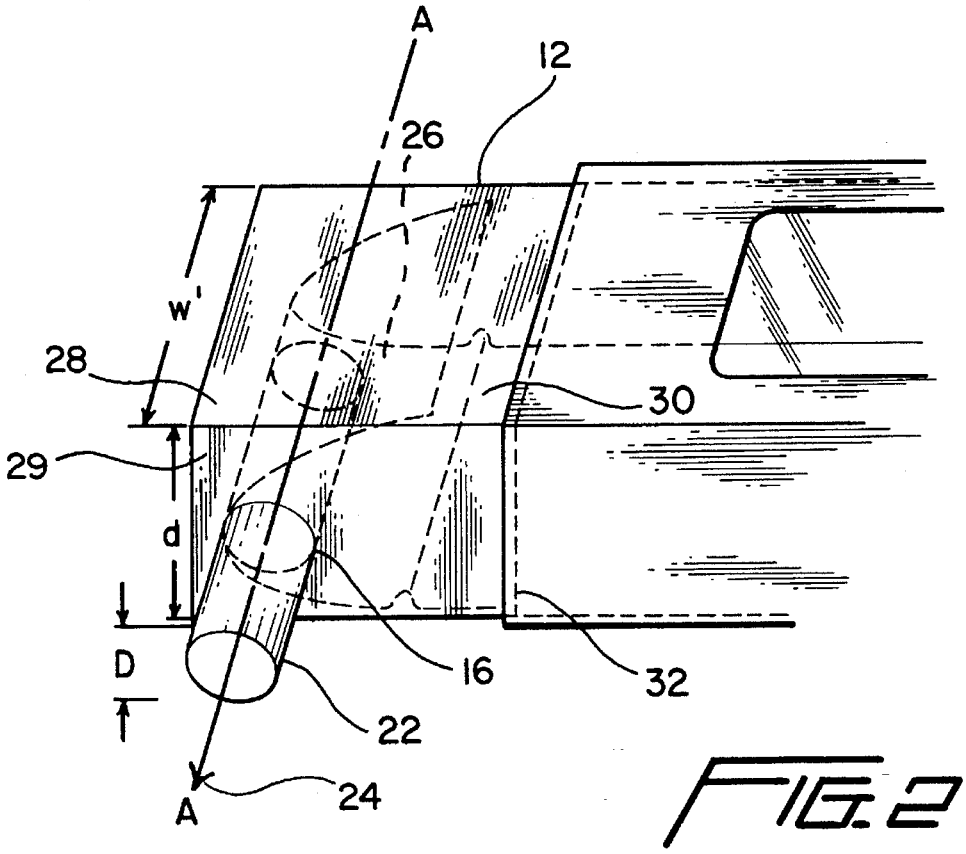
FIG. 2 is a perspective detail of the package of FIG. 1 illustrating certain orientational and dimensional features of a preferred embodiment of the present invention.

FIG. 2 is a perspective detail of the container of FIG. 1, illustrating certain orientational and dimensional features, as well as, internal structures of the box 12. The cigarette 22 (shown in partial phantom) is cylindrical and has an axis of elongation A—A. The box 12 has a cavity width which is approximately equal in length to the cigarette. Advantageously, the box is loaded with a number of other cigarettes (not shown), with their axes of elongation oriented generally parallel to axis A—A. The depth d of the box may be selected to accommodate two rows of cigarettes.

As shown in FIG. 2, the cigarette has a diameter D. The aperture 16 has a diameter sufficient in size to permit the one cigarette 22 to pass out of the box in the general direction of the axis of elongation as indicated by the arrowhead 24.

An inner surface or ramp 26 (shown in phantom) of the box 12 is configured to align the cigarettes, one at a time, so that an end of the cigarette is aligned with the aperture prior to dispensing. The ramp surface 26 may be provided by a flap extending from a top face wall 28 of the box in an arcuate path toward a parallel bottom face wall 30 of the box. In a preferred embodiment, the flap is curved about the axis A—A and is spaced from the axis by a distance of approximately D/2 at its point of closest approach.

The aperture 16 is located near the bottom end of box side wall 32, but spaced from both the wall 29 and the face walls 28 and 30. In this way, no edge of the aperture lies on a fold or cut line of a box blank from which the box is formed. It will be readily appreciated that the ramp surface 26 functions to align the cigarette 22 with the aperture.

Figure 3:
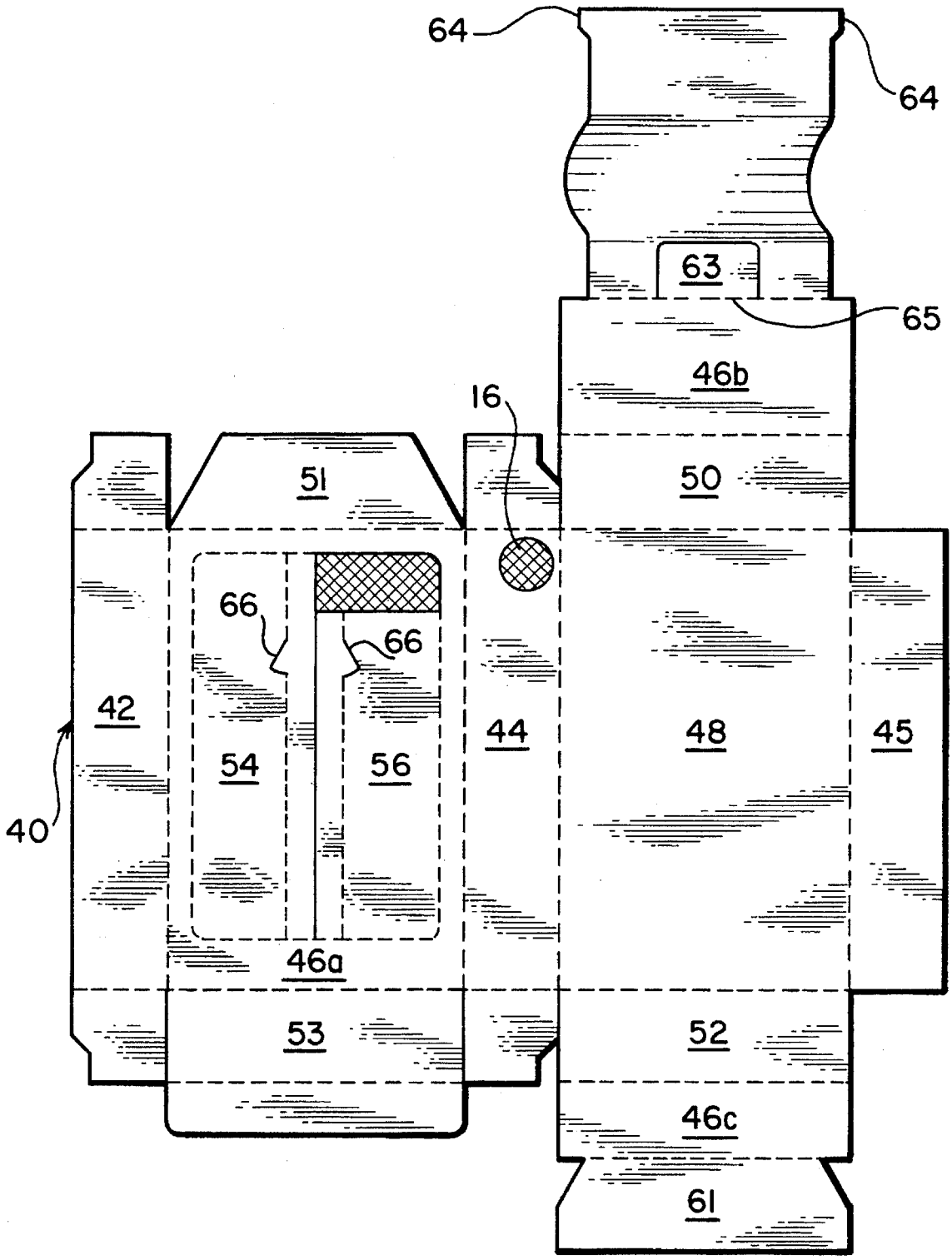
FIG. 3 shows a blank used to form a portion of the container of a preferred embodiment of the present invention.
Figure 4A:
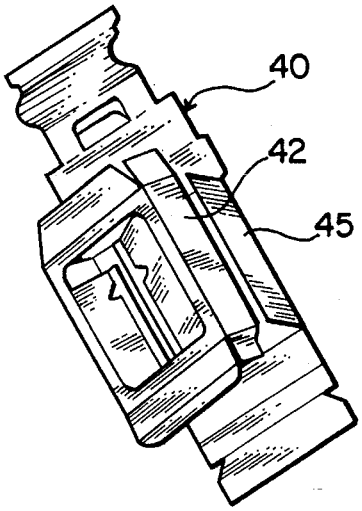
FIGS. 4(*a–h*) illustrate sequential folding, gluing, loading and wrapping steps employing the blank of FIG. 3.
Figure 4B:
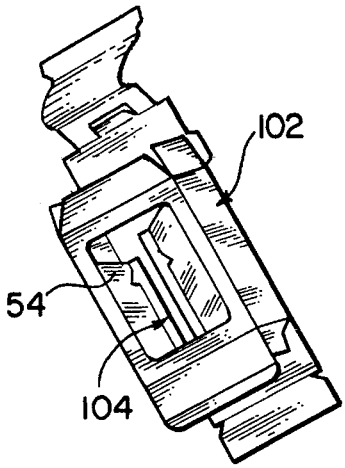
Figure 4C:
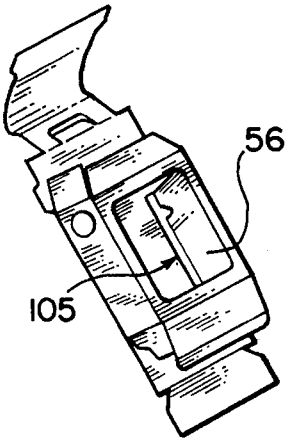
Figure 4D:
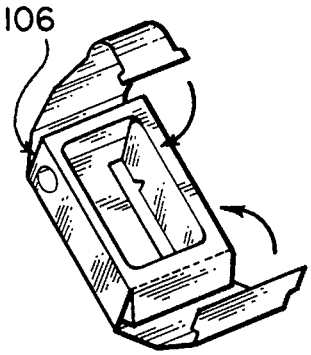
Figure 4E:
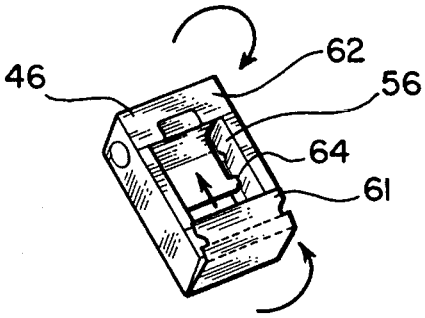
Figure 4F:
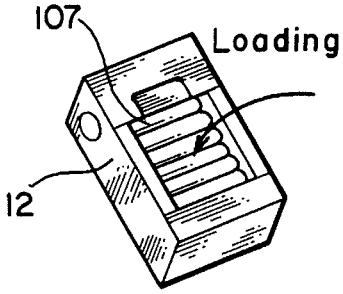
Figure 4G:
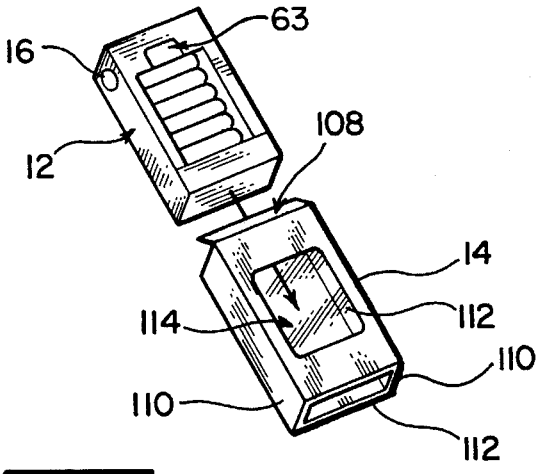
Figure 4H:
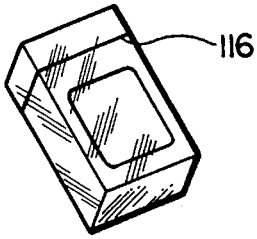

FIG. 3 shows a blank 40 used to form the box or tray portion of the container of a preferred embodiment of the present invention. In the Figure, solid lines represent cut or edge lines and broken lines represent score lines. Removed material is indicated by cross-hatching.

The outer walls of the box are formed from the portions of the blank identified as follows:

side walls—42, 44 and 45;

face walls—46 (*a–c*) and 48;

top end wall—50 and 51;

bottom end wall—52 and 53.

Separate inner walls of the box are formed from the portions of the blank identified as follows:

side walls—54 and 56;

bottom end wall—61.

In addition, a scored flap portion 62 of the blank is provided for forming an arcuate inner end wall or ramp in the box as will be described in greater detail below. The flap portion 62 is formed with tabs 64 adapted to interfit with cutouts 66 located in the inner side wall portions 54 and 56. A locking tab 63 may be defined by cut lines while still attached at score line 65. The function of the locking tab 63 will be described below.

FIGS. 4(*a*) through (*h*) illustrates sequential folding, gluing, loading and wrapping steps employing the blank of FIG. 3. In FIG. 4(*a*) the initial fold-down of the blank 40 is performed. In FIGS. 4(*b*) and 4(*c*) glue is applied in the areas designated by the numbers 102, 104, and 105. More specifically, the side wall portions 42 and 45 are glued together at 102. As indicated by the numerals 104 and 105, glue is also applied to edges of the inner side wall portions 54 and 56 to attach those edges to the bottom face wall 48. As a result of these gluing operations, the face walls and side walls of the blank are held perpendicular to each other.

Referring now to FIG. 4(*d*), further folding of the blank is performed and glue is applied at the location designated by the numeral 106 to attach the top end wall portions 50 and 51.

FIG. 4(*e*) illustrates the folding and tucking of the flap portion 62 so that the tabs 64 interfit with the cutouts 66 in the inner side walls 54 and 56 of the box being formed. Inner end wall portion 61 is also tucked into the box to complete the formation of the box. It will be understood from examination of Figures that the folding, gluing and tucking operations thus far described have resulted in the forming of a box having outer, mutually perpendicular side walls, face walls and end walls. Moreover, it will be clear that the side and end walls of the resulting box are formed by at least two spaced portions of the original blank shown in FIG. 3 thus giving the box added rigidity.

FIG. 4(*f*) illustrates the loading of cylindrical articles or cigarettes into the formed box. Advantageously, the articles may be gravity-loaded into the box by rolling the articles into position through an opening 107 in the box.

In FIG. 4(*g*) the container is assembled by slidably interfitting the body box or tray 12 with the cover sleeve 14. The sleeve 14 includes side walls 110 and face walls 112 which are arranged and configured to slide across the corresponding side walls and face walls of the box to selectively block the circular aperture 16. As shown in the Figure, the sleeve 14 may be formed with a locking flap 108 which is positioned in readiness to engage the locking tab 63 when the sleeve is located in a closed position. When the sleeve is moved to expose the circular aperture the flap 108 and tab 63 engage to impede complete removal of the sleeve. The locking flap 108 and locking tab 63 inhibit excessive sliding motion of the sleeve which might cause the sleeve to become detached from the box during use.

In a preferred embodiment, the sleeve 14 is formed with a transparent window 114 in the face wall 112 of the sleeve. When the container is closed, the contents of the box 12 may be viewed through the window 114 and face wall opening 107.

FIG. 4(*h*) illustrates the finished container which has been over-wrapped with a flexible transparent sheet. A tear tape 116 is provided to facilitate opening of the package.

In operation, the container formed from the blank 40 may be accessed and a cigarette dispensed from the container by grasping the sleeve 14 between the fingers of one hand and pressing on the bottom end of the box so that a top end of the box telescopes from the sleeve sufficiently to expose aperture 16. The box may be inverted and a single cigarette 22 may then be aligned on the internal ramp and dispensed through the aperture.

Figure 5:
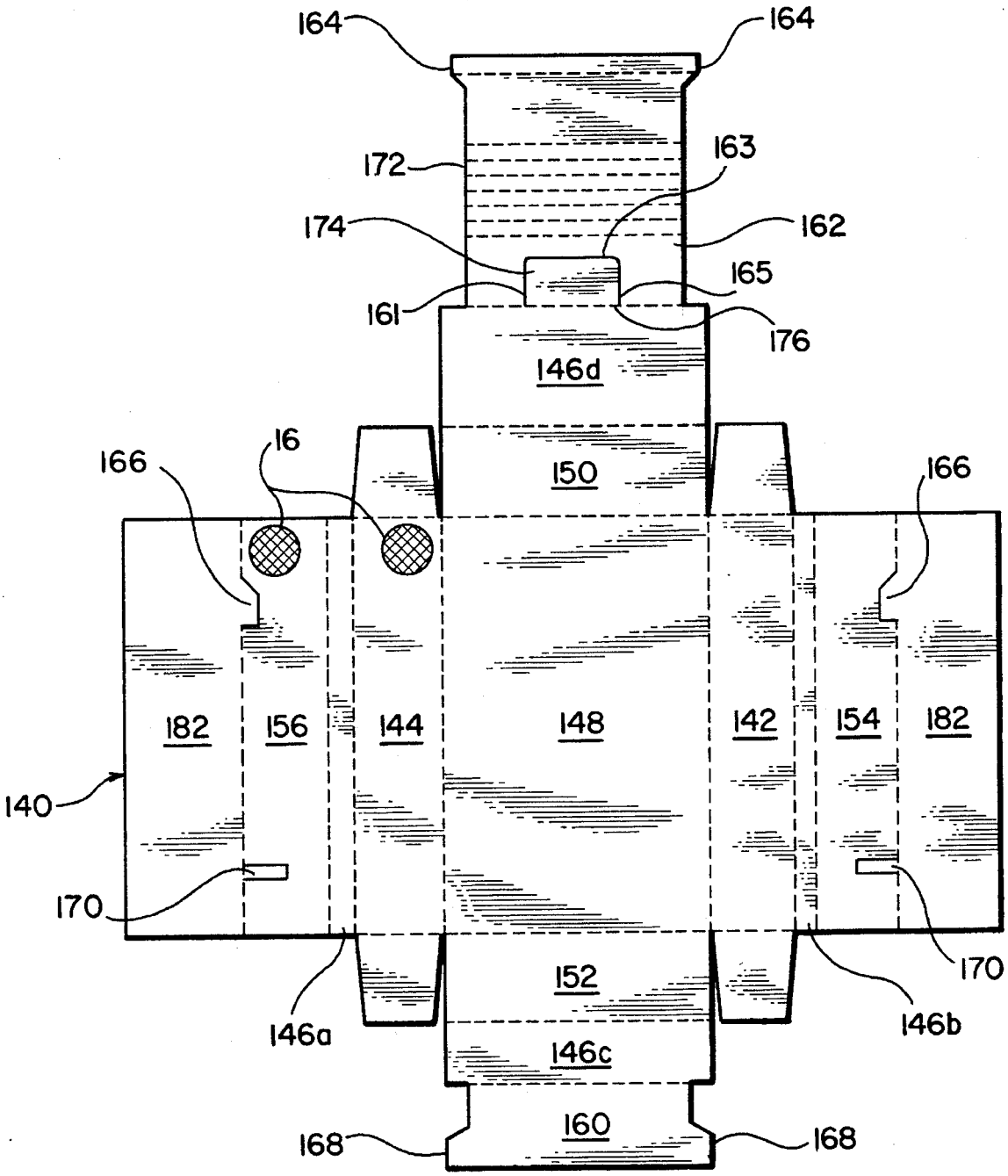
FIG. 5 shows a blank used to form a portion of the container of another preferred embodiment of the present invention.
Figure 6A:
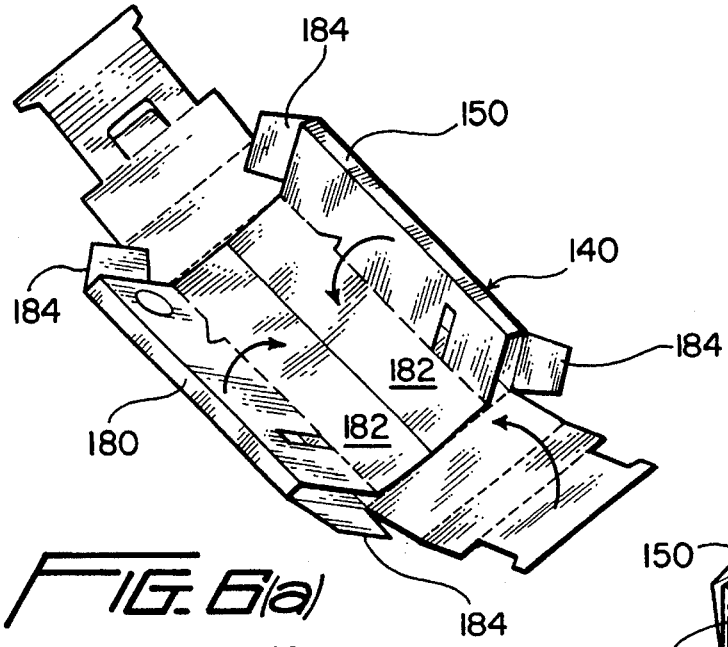
FIGS. 6(*a–e*) illustrate sequential folding, gluing and loading steps employing the blank of FIG. 5.
Figure 6B:
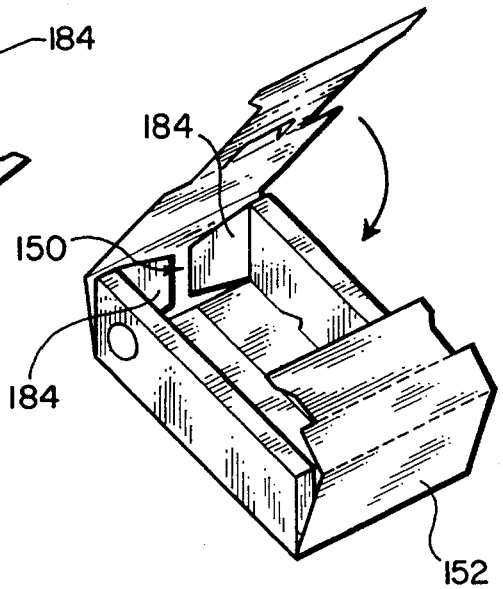
Figure 6C:
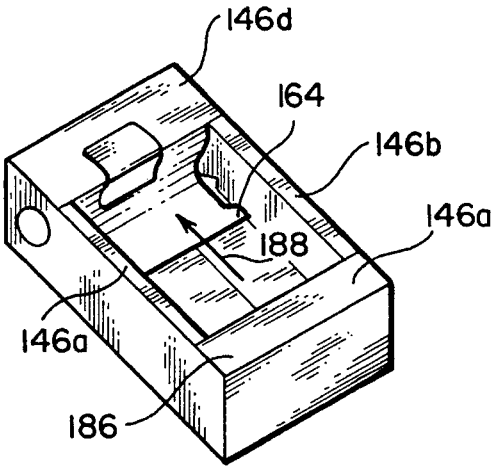
Figure 6E:
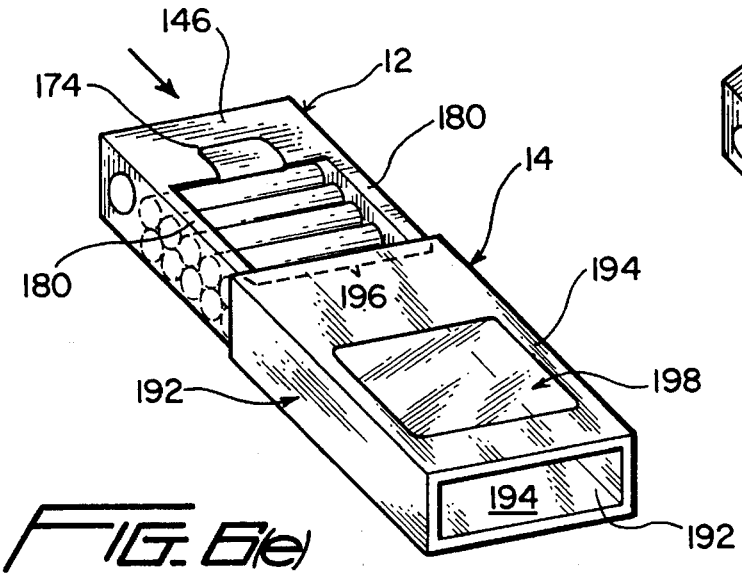
Figure 6D:
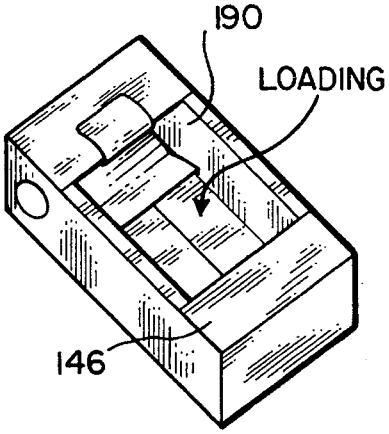

FIG. 5 shows a blank 140 used to form the box or tray portion of a container of another preferred embodiment of the present invention. As in FIG. 3, solid lines represent cut or edge lines and broken lines represent score lines. Removed material is indicated by cross-hatching.

The outer walls of the box are formed from the portions of the blank identified as follows:

side walls—142 and 144;

face walls—146 (*a–d*) and 148;

top end wall—150;

bottom end wall—152.

The inner walls of the box are formed from portions of the blank identified as follows:

side walls—154 and 156;

bottom end wall—160.

A flap 162 is provided to form an arcuate top inner wall of the formed box. The flap 162 includes tabs 164 which are positioned and dimensioned to tuck into cutouts 166 of the inner side walls 154 and 156. Similarly, tabs 168 are formed on the inner bottom end wall 160. The tabs 168 are dimensioned and configured to tuck into cutouts 170 of the inner side walls 154 and 156 in order to hold the inner top end wall 160 in position in the formed box.

Referring once again to the flap 162, it will be observed that the flap is formed with parallel score lines 172 which facilitate forming the flap 162 into an arcuate wall or ramp for aligning the cylindrical articles contained in the box. A locking tab 174 is also formed in the flap 162 by cut lines 161, 163 and 165. The locking tab remains attached to the blank at fold line 176.

Finally, it should be observed that in the blank 140 of this preferred embodiment, two circular apertures 16 are formed in the side walls 144 and 156. As will be appreciated from the following discussion, both apertures are necessary in order to provide access through the double side wall formed when side wall portions 144 and 156 are aligned parallel to one another in the formed box.

FIGS. 6(*a*) through (*e*) illustrate sequential folding, gluing, loading and assembling steps employing the blank of FIG. 5. As shown in FIG. 6(*a*), the blank 140 may be folded to form double side walls 180. The side walls may be secured in position by gluing the flaps 182 to the face wall portion 148 of the blank.

Turning now to FIG. 6(*b*), the forming of the end walls is illustrated. In this stage of formation, flaps 184 are positioned for gluing to the outer end walls 150 and 152.

In FIG. 6(*c*) the face wall portion of the box has been formed from the blank portions 146(*a–d*). In addition, tabs 168 have been tucked into cutouts 170 to form a double upper end wall 186 of the box. Flap 162 has been folded into the box and can be moved in the direction of arrow 188 until the tabs 164 engage the cutouts 166 in the inner side walls of the box, thereby locking the flap 162 into position within the box.

Referring now to FIG. 6(*d*), the box formed by the operations previously described is seen to have a face wall with a large rectangular opening 190. Two longitudinal columns of smoking articles may be gravity-loaded into the box by rolling the articles into position through the opening 190.

In FIG. 6(*e*) the box 12 is mated with a sleeve 14 to assemble the finished container. It will be observed that the sleeve has side walls 192 and face walls 194 which correspond with double side walls 180 and face walls 146 and 148 of the formed box. As was the case with the previously described embodiment, the locking tab 174 is positioned to restrict movement of the sleeve 14 with respect to the box 12. More specifically, the locking tab 174 engages a locking flap 196 (shown in phantom) of the sleeve to restrict the telescoping motion of the box with respect to the sleeve and thereby prevent disengagement of the box from the sleeve. Advantageously, the sleeve 14 may be formed with a transparent window 198 through which the contents of the box 12 may be observed.

The invention herein has been described in relation to a number of preferred embodiments. These embodiments are intended to be illustrative rather than restrictive. The scope of the invention claimed herein can be determined with reference to the appended claims.

I claim:

1. An article of manufacture comprising:

a box having pairs of side, face and end walls and having a circular aperture in a side wall:

a sleeve having pairs of side walls and face walls slidable across the corresponding side walls and face walls of the box to expose the circular aperture; and cylindrical smoking articles packed in two columns in the box, each having its principle axis aligned approximately parallel to a box end wall and each having a aperture, wherein the box is formed with an inner surface curved to align smoking acticles from either column with the circular aperature, one at a time. curved to align smoking articles from either column with the circular aperture, one at a time.

2. The article of manufacture of claim 1, wherein the inner surface of the box is curved about an axis generally parallel to the principle axes of the packed smoking articles.

3. A container loaded with elongated cylindrical smoking articles, comprising:

a box having a pair of side walls, and a pair of face walls, the pairs of walls being generally perpendicular, and having a pair of end walls each with a dimension approximately equal to the length of the cylindrical articles, a plurality of elongated cylindrical smoking articles stacked longitudinally in two, unseparated columns, wherein one of the side walls of the box is formed with an aperture located near one end of the side wall but spaced from the end wall and the face walls, the aperture being of sufficient size to permit the cylindrical articles to pass therethrough in the direction of elongation, one at a time, and wherein an inner wall of the box is configured to align cylindrical articles from either column to position the lowermost cylindrical article with one end thereof located at the aperture, and a sliding closure member, selectively positionable across the aperture to prevent articles from passing through the aperture.

4. The container of claim 3, wherein the sliding closure member is a sleeve having pairs of side and face walls slidable across the corresponding side and face walls of the box.

5. The container of claim 4, wherein a face wall of the box is formed with an opening which is selectively exposed to reveal the contents of the box by sliding the sleeve.

6. The container of claim 4, wherein a face wall of the box is formed with an opening and wherein the opening is covered by a transparent window in the sleeve.

7. The container of claim 4, further comprising means for restricting slidable movement of the sleeve through a range permitting selective blocking and unblocking of the aperture.

8. The container of claim 3, wherein the inner wall is a flap extending from one face wall in an arcuate path to the other face wall.

9. The container of claim 8, wherein the flap is formed with tabs which engage the side walls to retain an end of the flap against said other face wall.

10. The container of claim 8, wherein the aperture is circular and wherein the inner wall is curved about an axis which passes through the center of the aperture and which is generally parallel to the face walls.

11. A method for loading and dispensing cylindrical smoking articles from a container comprising the steps of:

providing a box with an opening in a face wall of the box, said box having an interior cavity with a width approximately equal to the length of the cylindrical smoking articles and a height at least approximately twice the diameter of the smoking article, and having a side wall formed with an aperture approximately equal in size and shape to the circular cross-section of the smoking article;

loading the cavity of the box with a plurality of smoking articles through the opening into at least two parallel columns;

sliding a sleeve over said box thereby closing the opening and the aperture;

sliding the sleeve with respect to the box a sufficient distance to expose the aperture but insufficient to expose the opening through which the smoking articles were loaded;

orienting the box to align an end of one of the smoking articles from one of the columns to a position adjacent to the aperture; and exposing an end of the one smoking article through the aperture, by shaking or tapping the box.

12. The method of claim 11, further comprising the step of wrapping the box and sleeve with a transparent wrap after loading.

13. The method of claim 11, wherein the smoking articles are gravity-loaded into the box by rolling the articles into position through the opening in the face wall of the box.

* * * * *